US006239338B1

(12) United States Patent
Robinson

(10) Patent No.: US 6,239,338 B1
(45) Date of Patent: May 29, 2001

(54) SAXOPHONE MUFFLER

(76) Inventor: David George Robinson, 2610 Southern Ave., Baltimore, MD (US) 21214

( * ) Notice: Subject to any disclaimer, the term of this patent is extended or adjusted under 35 U.S.C. 154(b) by 0 days.

(21) Appl. No.: 09/508,636

(22) PCT Filed: Sep. 15, 1998

(86) PCT No.: PCT/US98/19102

§ 371 Date: Jun. 16, 2000

§ 102(e) Date: Jun. 16, 2000

(87) PCT Pub. No.: WO99/14733

PCT Pub. Date: Mar. 25, 1999

(51) Int. Cl.[7] ..... G10D 7/08

(52) U.S. Cl. ..... 84/385 R; 84/385 A; 84/400; 206/314

(58) Field of Search ..... 84/385 R, 385 A, 84/400; 206/314

(56) References Cited

U.S. PATENT DOCUMENTS 4,738,180 * 4/1988 McKnight ..... 84/385 A 5,875,890 * 3/1999 Bernardini ..... 206/314

* cited by examiner

*Primary Examiner*—Shih-Yung Hsieh

(74) *Attorney, Agent, or Firm*—Law Offices of Royal W. Craig

(57) ABSTRACT

This invention relates to a muffler or mute for saxophone and other wind instruments comprising a muffling bag (10) with a durable external vinyl layer (12) and an internal layer of sound absorbing material (14). The saxophone (16) is entirely ensconced inside the saxophone muffler (except for the mouthpiece), and is securely held therein by an internal carriage assembly (30). The carriage assembly spaces and positions the saxophone, and hence the sound emanating from the keys as well as the bell of the saxophone is muted equally efficiently. Pockets (20) provided on the two sides of the saxophone enable the saxophonist to have access to the keys of the saxophone. A second hard-shell embodiment also functions as a mute and doubles as a saxophone carrying case.

15 Claims, 13 Drawing Sheets

SAXOPHONE MUFFLER

TECHNICAL FIELD

The present invention relates to mutes for wind instruments and more particularly to an improved mute for a saxophone which may also function as a saxophone carrying case.

BACKGROUND ART

Many conventional mutes for saxophones are known in the art. They generally comprise a structure adapted for fitting to the bell of a wind instrument.

For example, U.S. Pat. No. 5,569,864 to Hamanaga et al. discloses a mute for a wind instrument, the mute being formed of paper, wood, metal or synthetic resin and shaped in such a manner that it fits the bell portion of a saxophone. The mute has an inner surface shaped in such a manner that standing waves of representative harmonic tones have respective final nodes therein close to final nodes of the standing waves generated without the mute, and the pitch of the sound is hardly changed between a performance with the mute and a performance without the mute.

U.S. Pat. No. 5,309,808 to Tarrant discloses an acoustic practice mute for brass musical wind instruments having a bell end, which acoustically transmits muted sound to the ears of the player without distortion. The volume of sound reaching the ears of the player can also be regulated.

Other variations embodying the concept of muting the sound emanating from a wind instrument by adapting the mute to fit the bell portion of the wind instrument are known in the art. However, it must be noted that none of the mutes for wind instruments embodying the above mentioned principle can efficiently mute the sound emanating from a saxophone because the design of the saxophone differs from other wind instruments such that the saxophone not only allows sound to pass through its bell but also through its keys. Therefore a mute attached to the bell of a saxophone can only reduce the sound from the lower notes while the higher notes would remain relatively unmuted.

Hence, it can be seen that there exists a need for a muffler (mute),designed especially for saxophones, which can reduce the sound emanating from its keys as well as its bell. The saxophone muffler will have to be designed so that it is easily portable and it will allow a saxophonist unhindered use of all the saxophone keys. In addition, it will be advantageous to have a saxophone muffler that can also act as a carrying case for the saxophone, so that the saxophonist can avoid needing to carry a separate mute while traveling. This carrying case will be designed to protect the saxophone from impacts and also to act as a mute for the saxophone.

DISCLOSURE OF INVENTION

It is therefore desired to provide a muffler, especially designed for a saxophone, overcoming the above mentioned inadequacies in the prior art by effectively reducing the sound emanating from the saxophone by about 50% without impinging on the tonality of the sound produced.

It is yet another object of the invention to provide a saxophone muffler that can effectively mute the entire range of tonal frequencies produced by a saxophone, thereby serving as a practice aid for professional saxophone players as well as beginners.

It is yet another objective of the invention to provide a saxophone muffler that is light, compact, easily transportable, and capable of fitting a saxophone stand.

It is also an object of the invention to provide a saxophone muffler that can act as a saxophone carrying case capable of protecting the saxophone from impact stress and from exposure to the elements.

It is another object of the invention to provide a saxophone muffler that can be used in performance situations as well as practice, since only the volume and not the tonal quality of the instrument is reduced.

It is still another object of the present invention to provide a muffler which can be readily adapted for use with other wind instruments, such as clarinets, to achieve the same advantageous results.

In accordance with the above-described and other objects, the saxophone muffler of the present invention generally comprises a muffling bag having an interior layer made of soft layers of sound reducing materials, and an exterior layer made of a vinyl polymer, both being attached together and formed in the shape of a saxophone. The saxophone muffler covers the saxophone entirely, except for the mouthpiece. The two sides of the saxophone muffler are each provided with a pocket to enable the saxophonist to have unrestricted access to the keys of the saxophone. Because the saxophone is almost entirely ensconced inside the saxophone muffler, the sound emanating from the bell and the keys of the saxophone are equally muted to provide a muted output that does not impinge on the pitch but only reduces the volume of the output.

In the second embodiment the exterior layer of the saxophone muffler is modified to a light and rigid plastic material capable of protecting the saxophone from accidental impact and also equipped with means to allow it to function as a saxophone carrying case.

In both cases the muffler reduces volume considerably while the tonal quality of the instrument is not affected. Thus, the saxophone muffler can be used in performance situations as well as practice. Moreover, the muffler can be readily adapted for use with other wind instruments, such as clarinets, to achieve the same advantageous results.

BRIEF DESCRIPTION OF DRAWINGS

Other objects, features, and advantages of the present invention will become more apparent from the following detailed description of the preferred embodiment and certain modifications thereof when taken together with the accompanying drawings in which.

BEST MODE(S) FOR CARRYING OUT THE INVENTION

Figure 1:
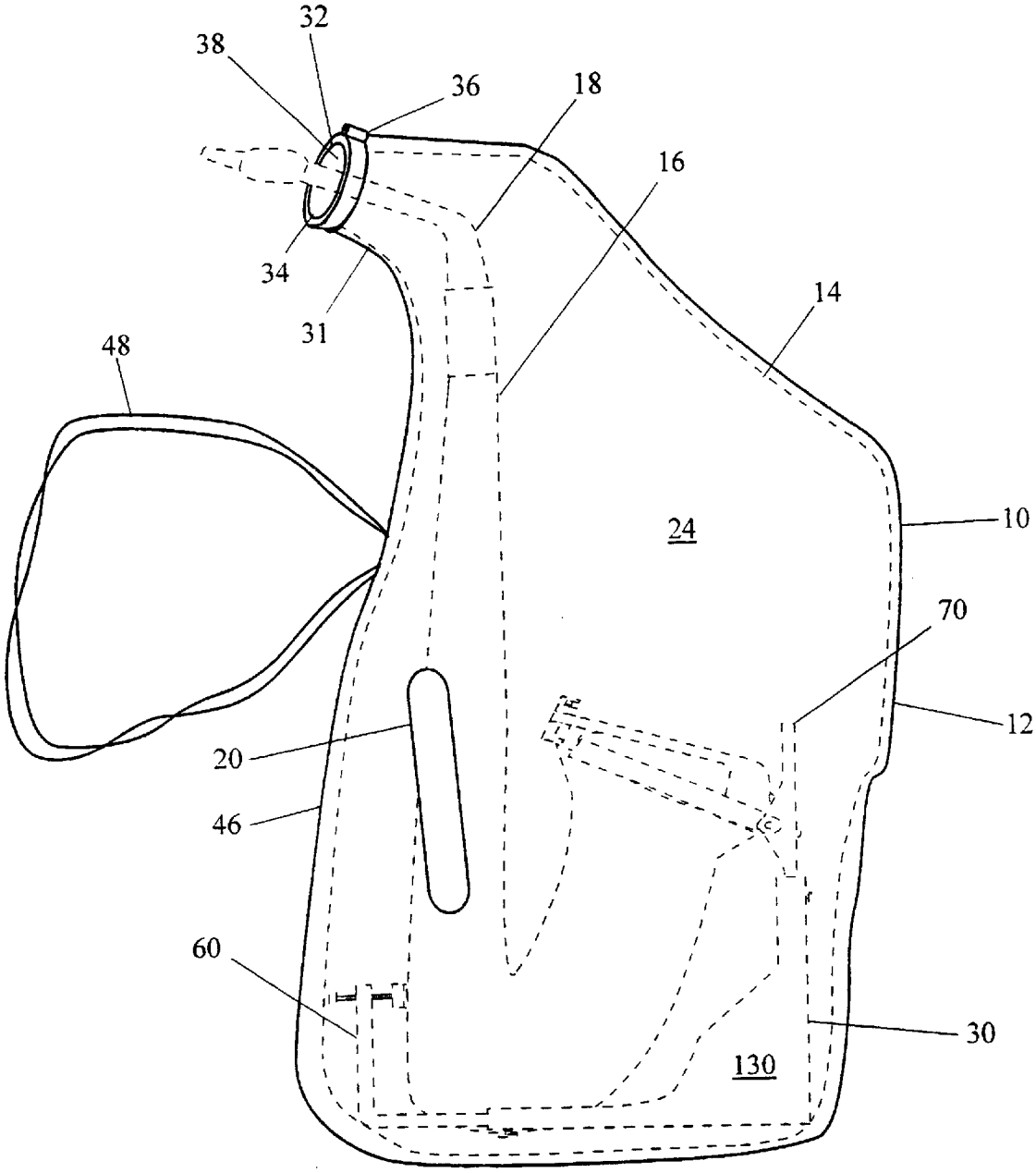
FIG. 1 is a right side view of one exemplary embodiment of the saxophone muffler according to the present invention.

FIG. 1 is a right side view of one exemplary embodiment of the saxophone muffler according to the present invention. The saxophone muffler comprises a sound-reducing muffling bag 10 sewn with an exterior layer 14 of durable vinyl fabric and an interior layer (not shown) of soft sound-damping material. The interior layer of sound-damping material 12 may be any suitable insulating foam or fibrous filler such as, e.g., polypropylene. Exterior layer 14 and interior layer 12 are sewn together at hem 14 to form a two-ply sound-reducing muffling bag 10 in the shape of a saxophone. The sound-reducing muffling bag 10 is provided with a number of apertures and fixtures (to be described) which allow insertion and play of a conventional saxophone 16. Sound-reducing muffling bag 10 covers the saxophone 16 entirely except for the mouthpiece, and thereby mutes the sound emanating from the saxophone bell as well as the saxophone keys.

To allow normal play, the saxophone muffling bag 10 is provided with pocket 20 on the right side 24 to provide the saxophonist with unhindered access to the right hand keys of the saxophone 16. The right pocket 20 provides access to the lower note keys, and it is sewn in proper position near the bottom half of the saxophone muffling bag 10.

Figure 2:
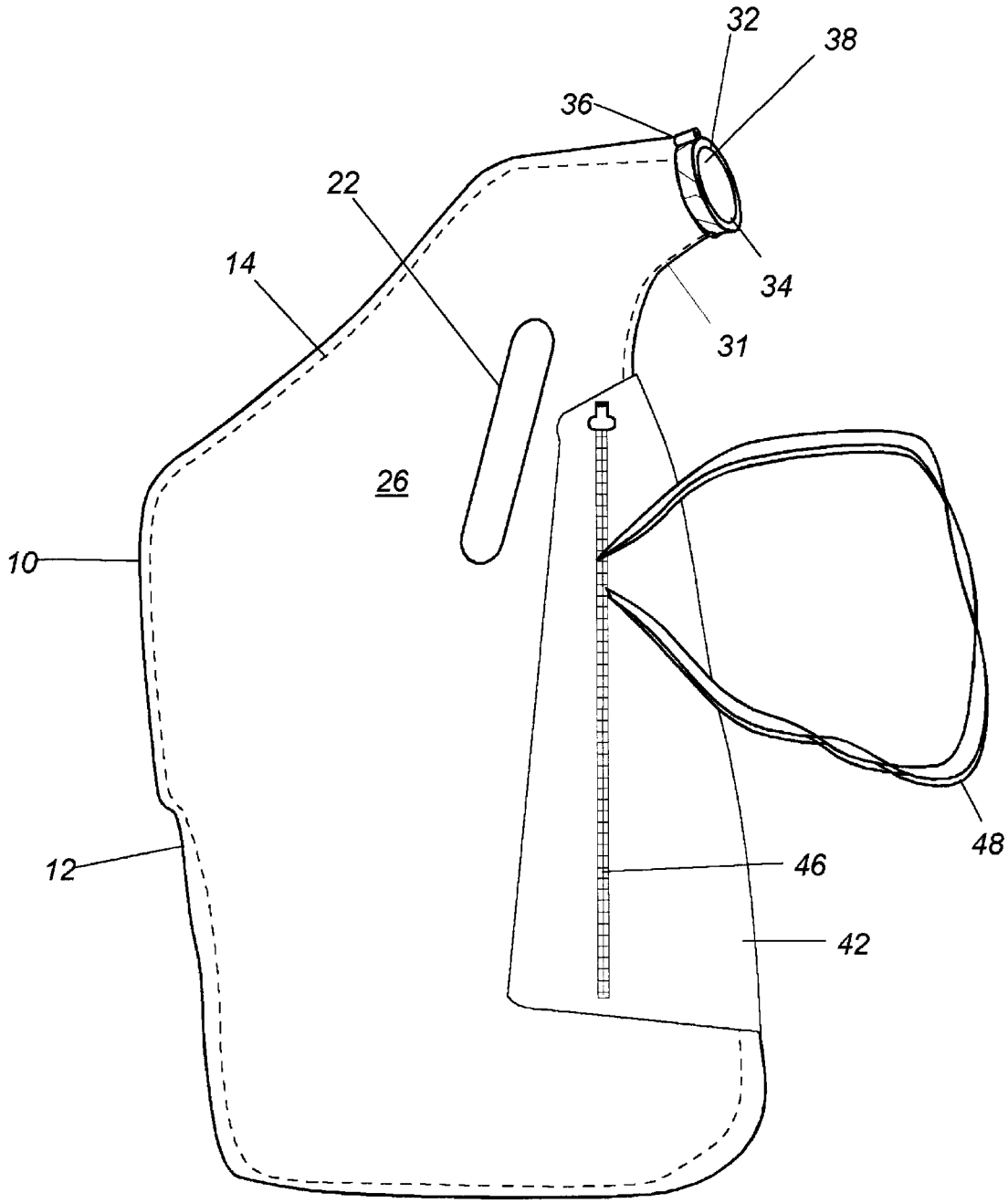
FIG. 2 is a left side view of the saxophone muffler as in FIG. 1.

FIG. 2 is a left side view of the saxophone muffler as in FIG. 1. A like pocket 22 is sewn into the left side of the saxophone 16 to provide access to the left hand upper note keys, and it is sewn in proper position near the top half of the saxophone muffling bag 10.

The saxophone muffling bag 10 is sewn with an upwardly extending neck 31 to accommodate the neck of saxophone 16, and neck 31 extends to an annular opening 32 which is reinforced by an adjustable collar 34. In the preferred embodiment, collar 34 is a molded annular plastic member which is secured around the fringes of the neck 31 material. The diameter of collar 34 should be adjustable to grip the neck of the inserted saxophone 16, and a tightening screw 36 provides this ability. It should be noted that various other collars may be used including a conventional O-ring with clamp to tighten about the saxophone neck. An off-set annular opening 32 is preferably filled by an elastomeric disk 34 formed with a hole 38 or slot to fit the neck of the saxophone 16. The elastomeric disk 34 provides padding about the saxophone neck so as not to scratch or otherwise damage it. Hole 38 can be tightened adjacent to the neck 18 using the clamp 36. The annular opening 32 in disk 34 must be sufficiently offset from center to ensure that there is sufficient room for the octave key (typically attached to the neck of conventional saxophones).

As seen in FIG. 2, the rear of the saxophone muffling bag 10 is left open, and the opening is large enough to facilitate placement and removal of the saxophone 16 inside the saxophone muffling bag 10. The opening may be closed and sealed via a fold-over flap 42 which folds from right side 24 to left 26 and is secured to the left side 26 by underlying hook-and-loop fastening patches, strips or the like. A zippered opening 46 is provided in the flap 42 to provide access to the neck strap 48 of the saxophone 16. The neck strap 48 may be used via zipper 46 to allow the saxophonist to play the saxophone 16 by supporting it with his neck using the neck strap 48.

As shown in dotted lines in FIG. 1, the present invention is equipped with an internal carriage assembly 30 which cradles the saxophone once seated therein. Carriage assembly 30 further comprises a mounting stand 130 having an adjustable supporting bracket 60 protruding horizontally outward at the bottom, and a saxophone bell brace 70 protruding upwardly from the top.

FIGS. 3–11 illustrate in detail the structure of the internal carriage assembly 30 of the saxophone muffling bag 10 of FIG. 1.

Figure 3:
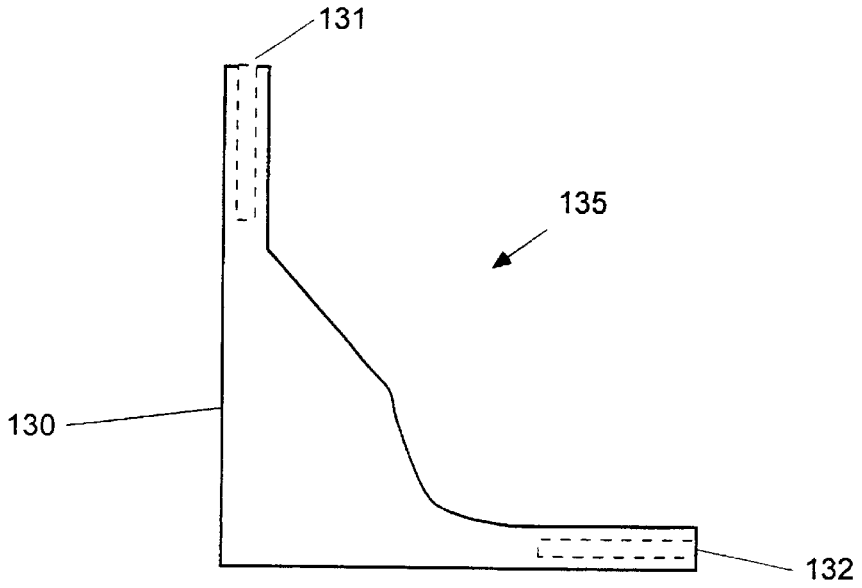
FIGS. 3 and 4 are an enlarged side view and front view, respectively, of the mounting stand 130 (shown in dotted lines in FIG. 1).
Figure 4:
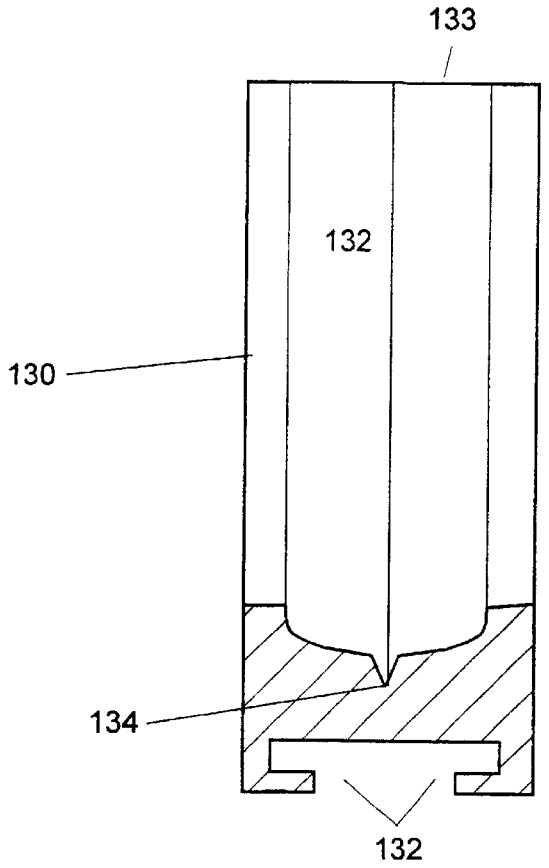

FIGS. 3 and 4 are an enlarged side view and front view, respectively, of the mounting stand 130 (shown in dotted lines in FIG. 1). Mounting stand 130 is a generally triangular member with a face 135 adapted to seat the saxophone 16. Mounting stand 130 may be formed from molded plastic or other suitable material. The rear and bottom of the mounting stand 130 are both formed with channels 131, 132 which have a T-shaped cross-section. Channels 131, 132 are adapted for slidable insertion of the adjustable supporting bracket 60 and saxophone bell brace 70, respectively (see FIG. 1). The inclined face 135 of mounting stand 130 is formed with a curved channel 133 which is contoured to the throat of the saxophone. The contoured channel 133 follows a semi-circular cross-section with a shallow V-notch 134 at the center.

Figure 5:
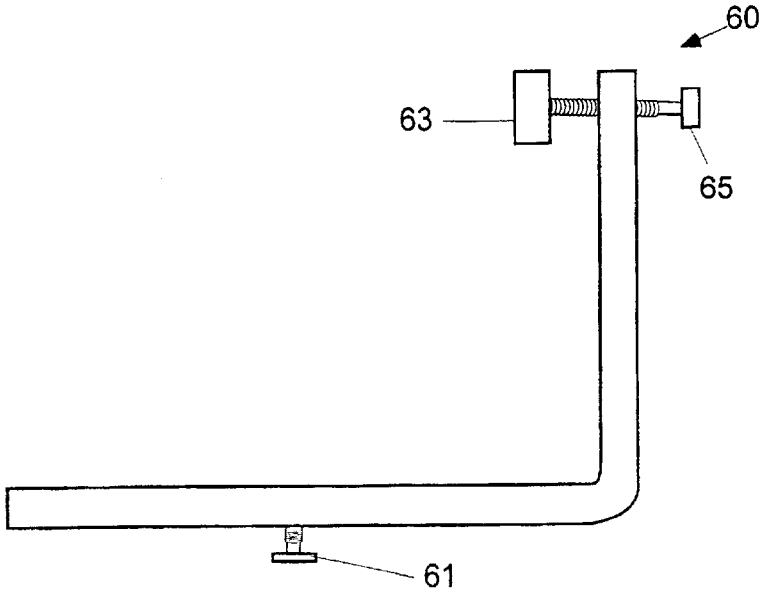
FIGS. 5 and 6 are an enlarged side view and front view, respectively, of the supporting bracket 60 (shown in dotted lines in FIG. 1).
Figure 6:
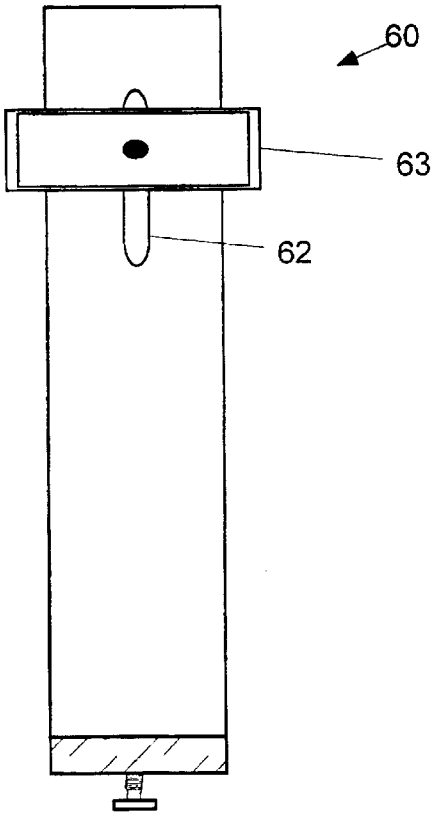

FIGS. 5 and 6 are an enlarged side view and front view, respectively, of the supporting bracket 60 (shown in dotted lines in FIG. 1).

Supporting bracket 60 is an adjustable metal or plastic extension from the mounting stand 130. Supporting bracket 60 has a uniform rectangular cross section for slidable insertion into the lower T-shaped channel 132 of mounting stand 130. The forward end (the inserted end) of supporting bracket 60 is equipped with a set screw 61 which may be tightened against the T-shaped channel 132, thereby locking the supporting bracket 60 in position relative to the mounting stand 130. The opposing end (the non-inserted end) of supporting bracket 60 is equipped with a notch 62. A support cuff 63 is mounted on the end of a set screw 65 which may in turn be tightened to push support cuff 63 against the back, bottom portion of the saxophone body, thereby fully supporting the rear portion of a saxophone within bag 10. Support cuff 63 is a semi-circular strut adapted to conform to the curved base of the saxophone 16. Preferably, a rubber strip is glued to the outward face of support cuff 63 to prevent scratching of the saxophone 16. The support cuff 63 is mounted on a rearwardly protruding stem 65 which passes through the notch 62 in supporting bracket 60. The extent of stem 65 may be adjusted to position the support cuff 63.

As seen in FIG. 1, the bell of the saxophone is also secured within the bag 10 by the internal carriage assembly 30, and this is accomplished by saxophone bell brace 70.

FIGS. 7–10 are enlarged drawings illustrating the components of the saxophone bell brace 70.

Figure 7:
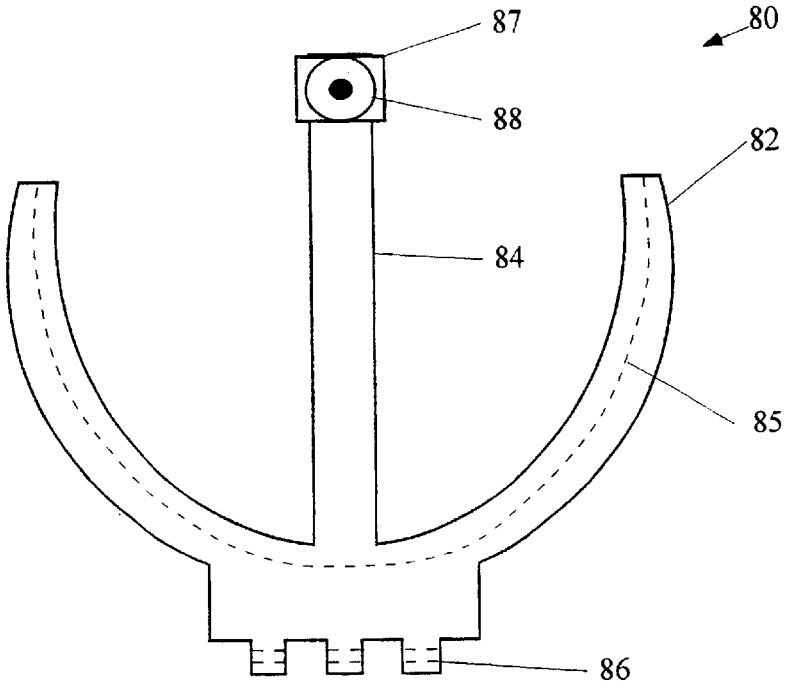
FIGS. 7 and 8 are a top view and side cross-sectional view, respectively, of the saxophone bell clamp 80.
Figure 8:
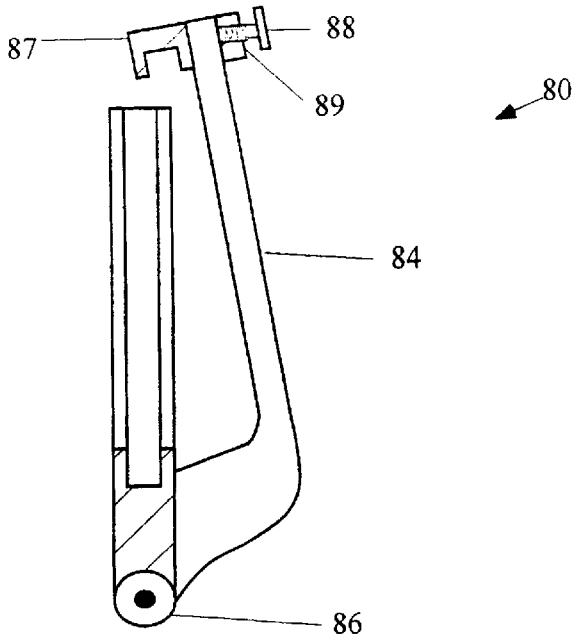

FIGS. 7 and 8 are a top view and side cross-sectional view, respectively, of the saxophone bell clamp 80. Saxophone bell clamp 80 comprises a C-shaped collar 82 and integral retaining arm 84. C-shaped collar 82 is adapted to partially encircle and thereby secure the bell of saxophone 16. In order to secure the bell, the C-shaped collar 82 has an internal channel 85 running around the entire inner periphery. When saxophone 16 is seated inside the muffling bag 10 on mounting bracket 130, the bell is slid into the C-shaped collar. The rim of the bell of saxophone 16 fits within the channel 85 of the C-shaped collar 82. The bell of saxophone 16 is then held within the C-shaped collar 82 by an adjustable clip 87 which is slidably mounted along the distal end of a retaining arm 84. As best seen in FIG. 8, clip 87 is a simple notched clip for retaining the rim of the saxophone 16 bell within the channel 85 of the C-shaped collar 82. Clip 87 is slidably secured to the underside of retaining arm 84 by a set screw 88 which passes through a back plate washer 89 and then a notch in the end of the retaining arm 84. Set screw 88 locks the clip 87 at a set distance from C-shaped collar 82, and thus allows adjustment to accommodate saxophones of various sizes. The C-shaped collar 82 and retaining arm 84 may be integrally molded of plastic, and a hinge 86 is provided at the center of the C-shaped collar 82.

Figure 9:
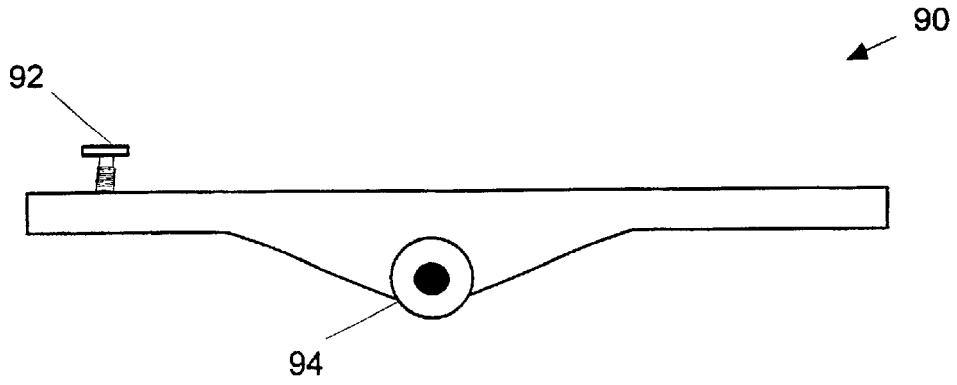
FIGS. 9 and 10 are a side view and front view, respectively, of the saxophone bell clamp extension 90 according to the present invention.
Figure 10:
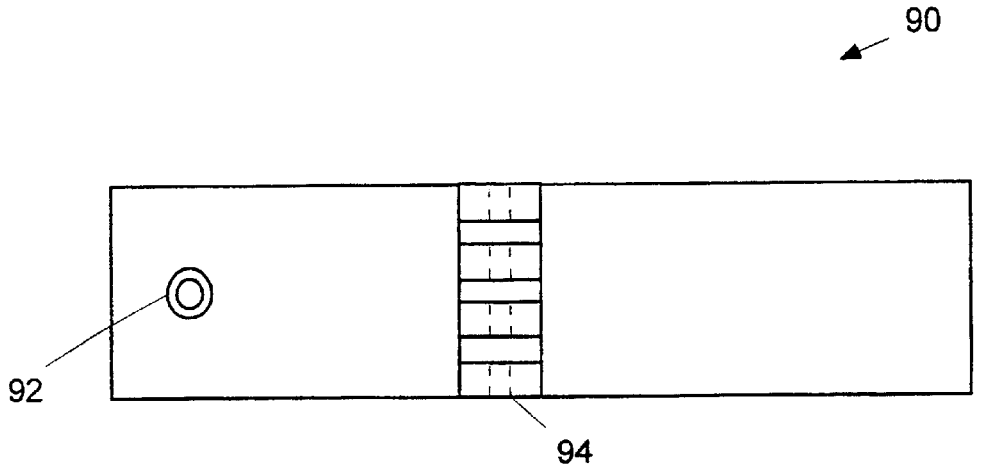

FIGS. 9 and 10 are a side view and front view, respectively, of the saxophone bell clamp extension 90 according to the present invention. Saxophone bell clamp extension 90 serves the purpose of adjustably connecting and extending the saxophone bell clamp 80 from mounting stand 130. Bell clamp extension 90 is a metal or plastic extension from the mounting stand 130. Bell clamp extension 90 has a uniform rectangular cross section for slidable insertion into the upper T-shaped channel 131 of mounting stand 130. The forward end (the inserted end) of bell clamp extension 90 is equipped with a set screw 92 which may be tightened against the T-shaped channel 131, thereby locking the bell clamp extension 90 in position relative to the mounting stand 130. The opposing end (the non-inserted end) of supporting bracket 60 is equipped with a hinge 94 and hinge 94 is adapted to pivotally mate with the hinge 86 at the center of the C-shaped collar 82. The extent of the bell clamp extension 90 may be adjusted to properly position the C-shaped collar 82 to match the height of the saxophone bell.

The internal carriage assembly 30 is attached within the muffling bag 10 by hook and loop fasteners, snaps or the like.

Figure 11:
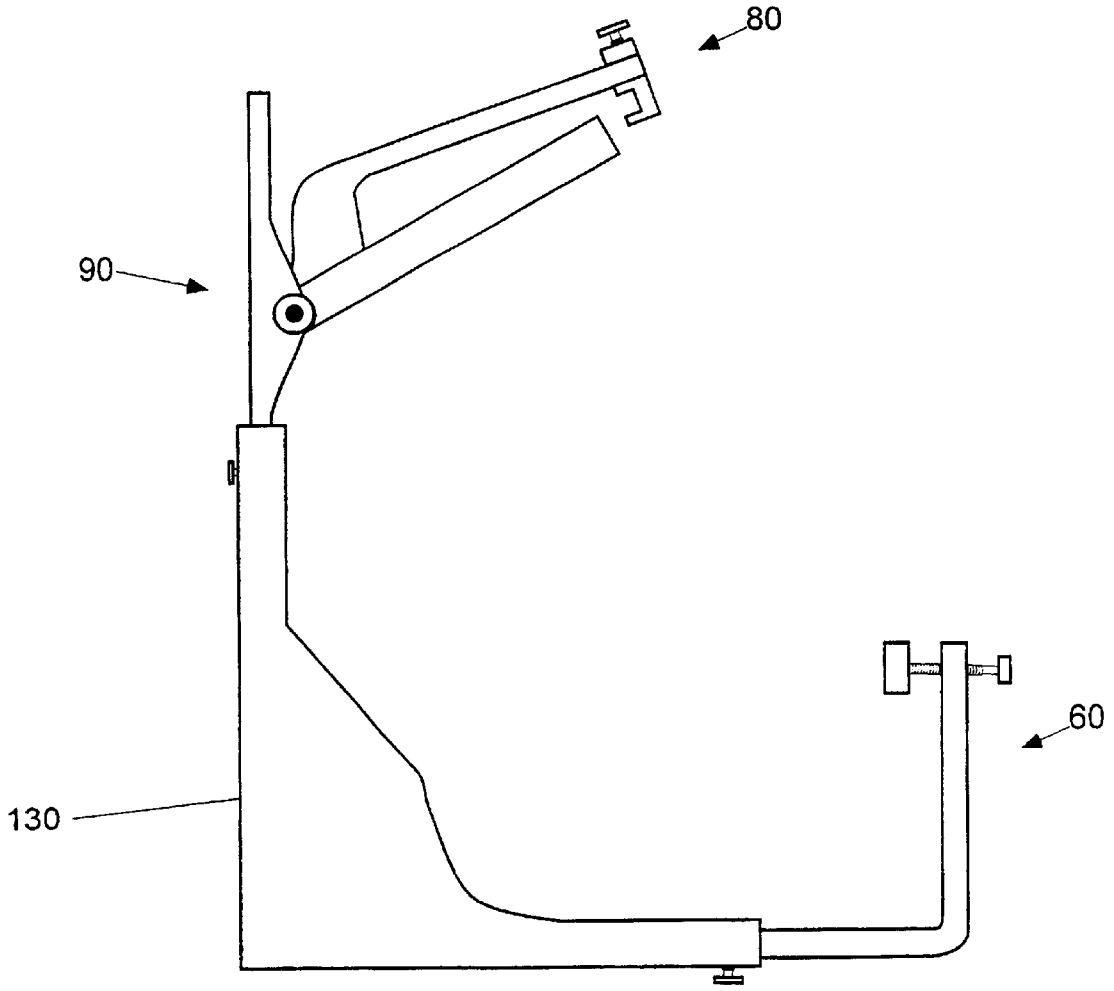
FIG. 11 is a side view illustrating the assembly of the above-described components into a complete internal carriage assembly 30.

FIG. 11 is a side view illustrating the assembly of the above-described components into a complete internal carriage assembly 30. Carriage assembly 30 ensures that the saxophone 16 is adequately supported within the saxophone muffling bag 10 so that a satisfactory air gap 58 is maintained between the bell 54 and the inner walls of the saxophone muffling bag 10. This air gap 58 is necessary so that the sound produced by the saxophone 16 is not distorted by premature internal reflection and interference.

In operation of the internal carriage assembly 30, supporting bracket 60 is inserted into the lower T-shaped channel 132 of mounting stand 130, is adjusted as desired, and is locked into position.

Likewise, the saxophone bell clamp 80 (including C-shaped collar 82) is inserted into the upper T-shaped channel 131 of mounting stand 130, is adjusted as desired, and is locked into position. The internal carriage assembly 30 is then attached to the bottom of the saxophone muffling bag 10 by hook and loop fasteners, snaps or the like.

The saxophone 16 is inserted by adjusting the saxophone bell clamp extension 90 to the proper height, sliding the saxophone bell into the C-shaped collar 82, applying clip 87 and tightening set screw 88. The barrel of saxophone 16 is then seated upon the curved channel 135 of mounting stand 130, the curved channel 135 being contoured to the throat of the saxophone and the central V-notch 134 accommodating the bridge of the saxophone 16.

As an added option, the saxophone muffling bag 10 can be designed to fit a conventional saxophone stand (not shown). This will enable the saxophonist to rest the saxophone 16 on the saxophone stand in between practice sessions without needing to remove the saxophone muffling bag 10.

During practice the saxophonist can now access the higher note keys through the pocket 24 and the lower note keys by using the pocket 22. The design of the saxophone muffling bag 10 ensures that the sound transmitted after absorption from the inner walls is free of distortion and reduced by 10 dB. This represents approximately a 50% reduction in the volume produced by the saxophone. Since the entire body of the saxophone 16 is effectively ensconced inside the saxophone muffling bag 10, the sound escaping through the keys of the saxophone is muted as effectively as the sound transmitted through its bell. Despite the muffler's ability to reduce volume considerably, the tonal quality of the instrument is not affected. Thus, the saxophone muffler can be used in performance situations as well as practice.

After the musician finishes practice the saxophone 16 can be taken out of the saxophone muffling bag 10 and the saxophone muffling bag 10 can be folded and stored in a compact manner.

In a second embodiment of the saxophone muffler of the present invention, the flexible muffling bag may be replaced by a hard plastic or vinyl shell. The shape and design of this saxophone muffling bag is similar to that of the durable vinyl fabric embodiment shown in FIG. 1. The primary difference between the two is that the exterior of the saxophone muffler is formed from a strong and light impact resistant polymer. This rigid, plastic outer shell aids in preventing damage to the saxophone 16 from accidental impact.

Rather than a front opening with flap, the shell opens via hinges positioned along the font edge of the case. Thus, the hard shell embodiment is better suited for use as a carrying case in addition to being able to mute the sound of a saxophone.

Figure 12:
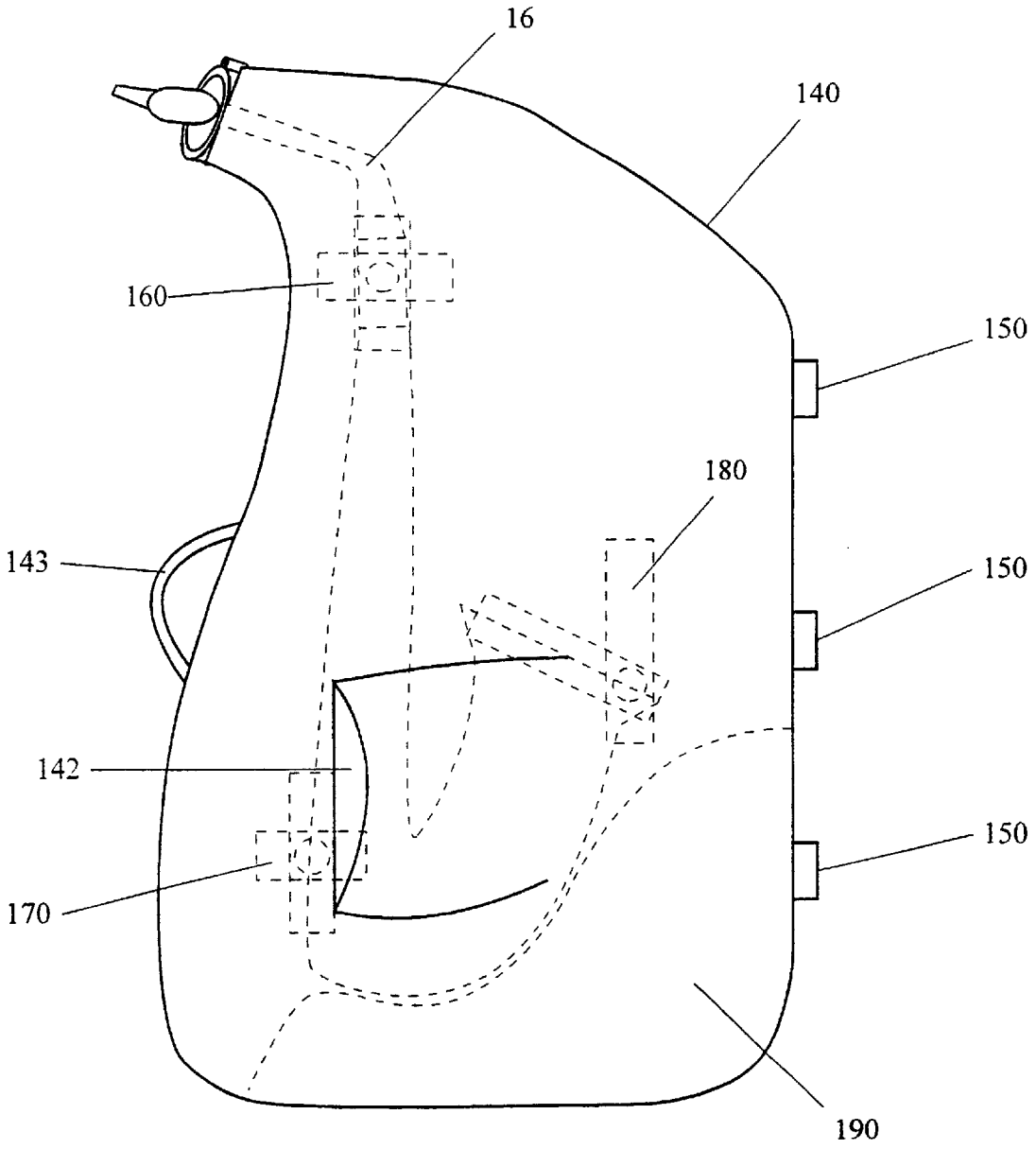
FIG. 12 is a right side view of a second embodiment of the saxophone muffler according to the present invention and incorporating a rigid plastic outer layer.
Figure 13:
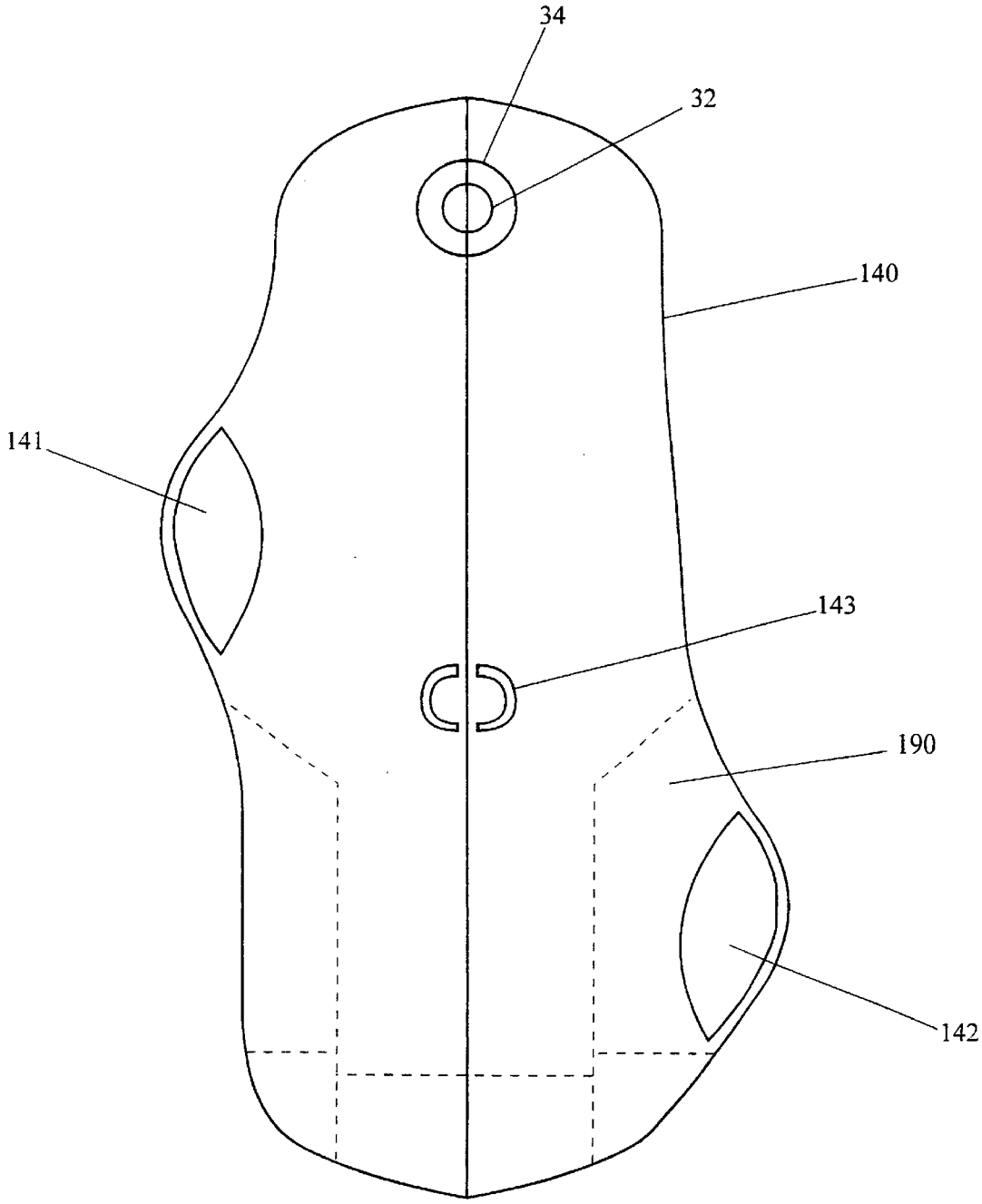
FIG. 13 is a rear view of the saxophone muffler of FIG. 12.

As shown more particularly in FIGS. 12 and 13, the hard case 140 has an outer contour that is very similar in appearance to the soft case embodiment of FIG. 1, and is provided with the general shape of a saxophone. As seen in FIG. 13, the left side wall of hard case 140 is provided with a rigid contoured opening 141 for receiving the user's left hand, and the right side wall of hard case 140 is provided with a rigid contoured opening 142 for receiving the user's right hand. Each of the rigid contoured openings may be provided with a fabric closure for closing the openings when the saxophone muffler is not in use. Each of those fabric closures are provided with an opening therein for providing access to the keys of the saxophone, the openings being closeable by any of a variety of known devices such as a flap closure having hook and loop fastening or snap closure means, or a simple zipper closure.

As in the soft case embodiment, the upper portion of hard case 140 is provided with an annular opening 32 which is reinforced by a collar 34. Once again, in the preferred embodiment, an off-set annular opening 32 is filled by an elastomeric disk formed with a hole or slot to fit the neck of a saxophone 16 to provide padding about the saxophone neck.

Handles 143 are provided on the rear wall of the hard case 140 to facilitate easy transport of the case 140 when not in use.

Figure 14:
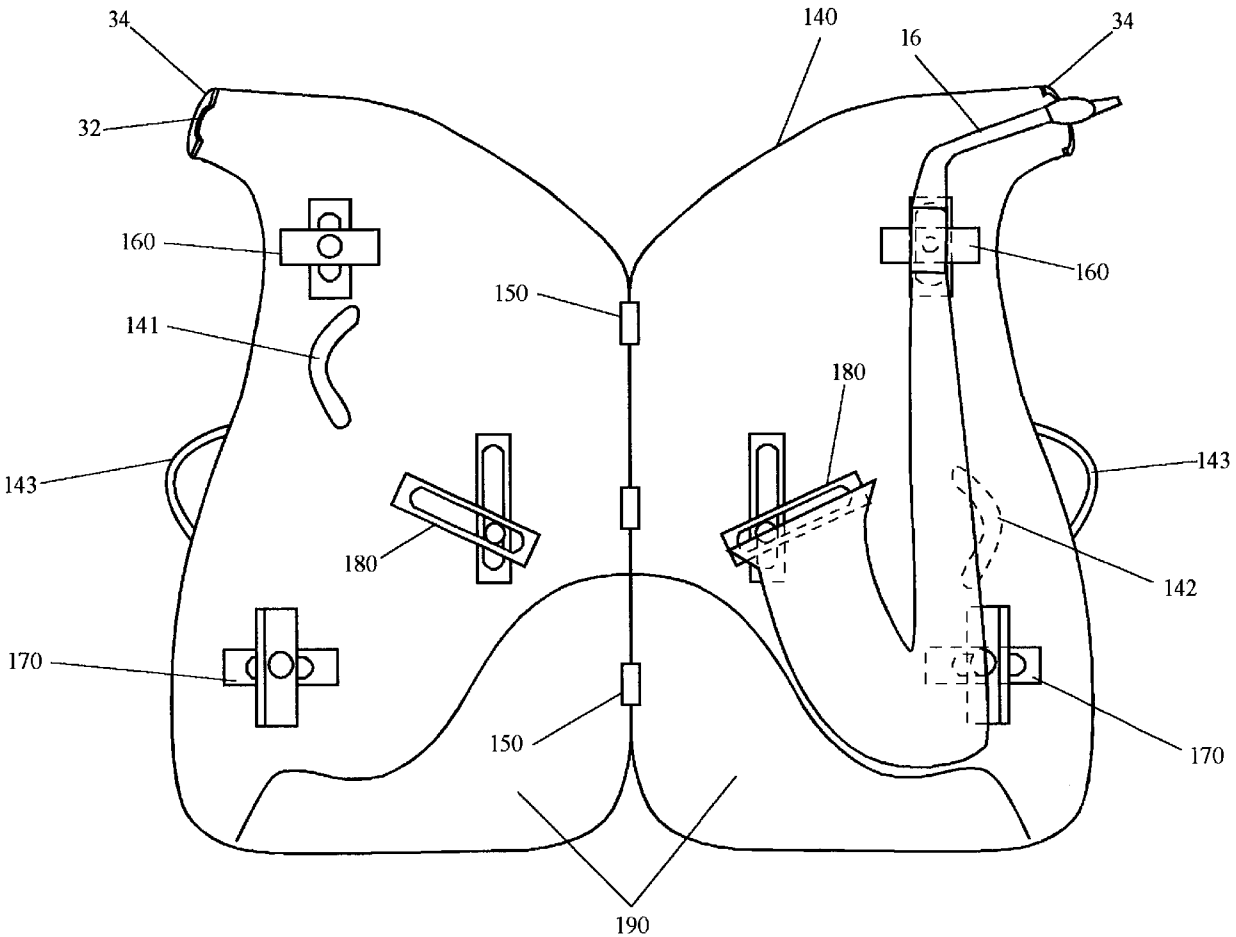
FIG. 14 is a side view of a fully opened saxophone muffler of FIG. 12.

As shown in FIG. 14, hard case 140 may be opened by pivoting the left and right sides about their common front ends via hinges 150, allowing the user ample space to manipulate the saxophone into its proper seated position within the case. To support the saxophone within hard case 140, a plurality of support mechanisms are mounted on the interior of each of the left and right side walls of hard case 140, including an upper support bracket 160, a lower support bracket 170, a bell clamp 180, and an increased thickness section of sound dampening material 190, each of which are equipped to support a distinct portion of saxophone 160.

Figure 15:
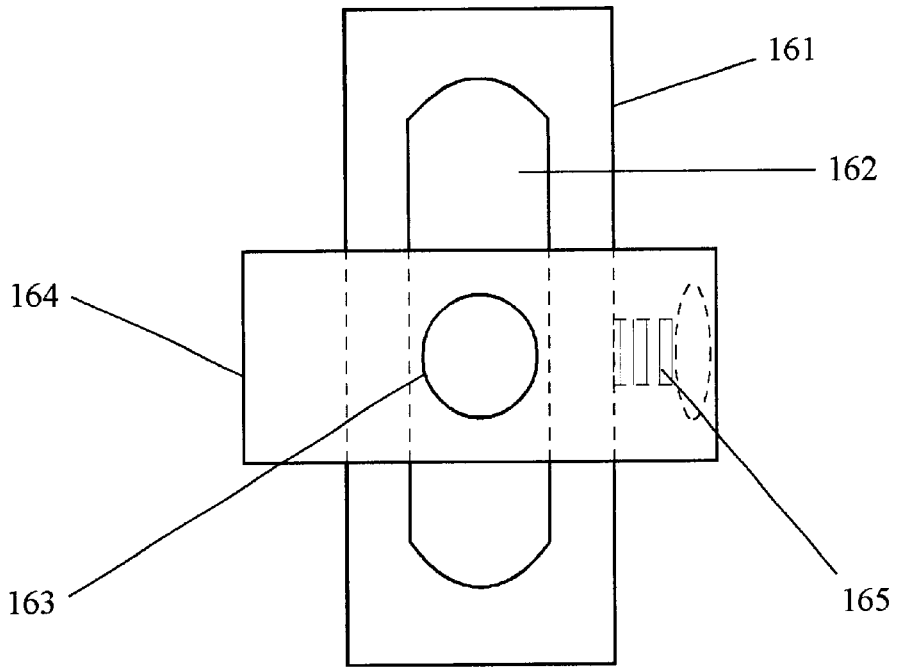
FIGS. 15 and 16 are an enlarged side view and top view, respectively, of an upper support bracket 160.
Figure 16:
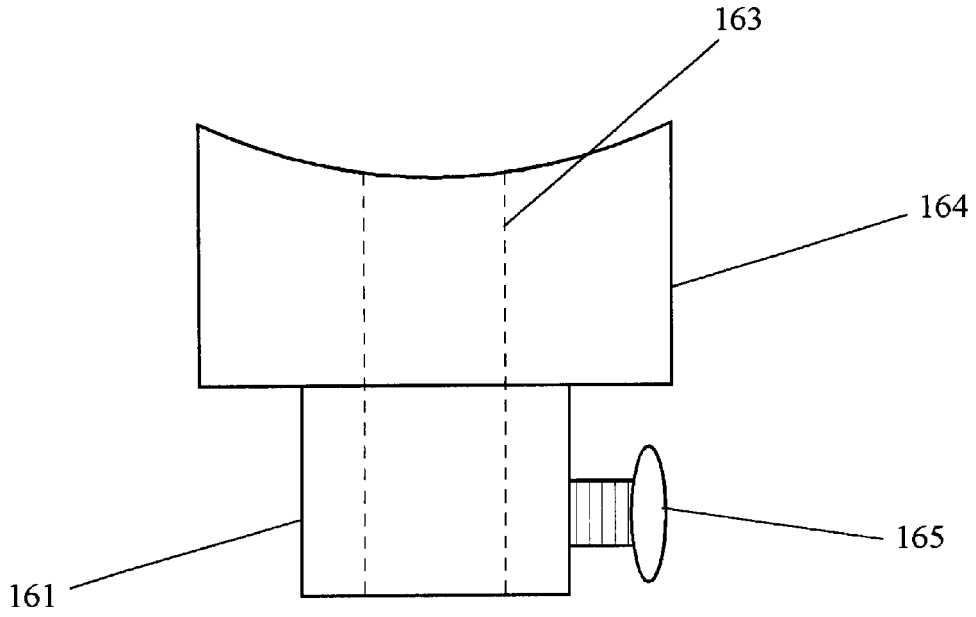

FIGS. 15 and 16 are a side view and a top view, respectively, of an upper support bracket 160. Upper support bracket 160 comprises a vertical support member 161 which is bolted or otherwise affixed to the interior side walls of hard case 140. Vertical support member 161 is equipped with a vertical slot 162, and carries a horizontally extending post 163. Post 163 in turn carries a horizontally disposed support cuff 164 which is configured to snugly seat against the upper portion of the body of a saxophone, just below the juncture of the body and the neck. Horizontally extending post 163 is slidably mounted within slot 162, and its position within slot 162 may be locked at any desired location using a simple set screw 165. Set screw 165 rides in a second slot (not shown) provided on the side wall of vertical support member 161, and may be tightened against vertical support member 161, thereby locking the vertical position of support cuff 164. Thus, the position of the support cuff may be placed at any desired position within the extent of slot 162 in order to receive saxophones of varying dimensions.

Figure 17:
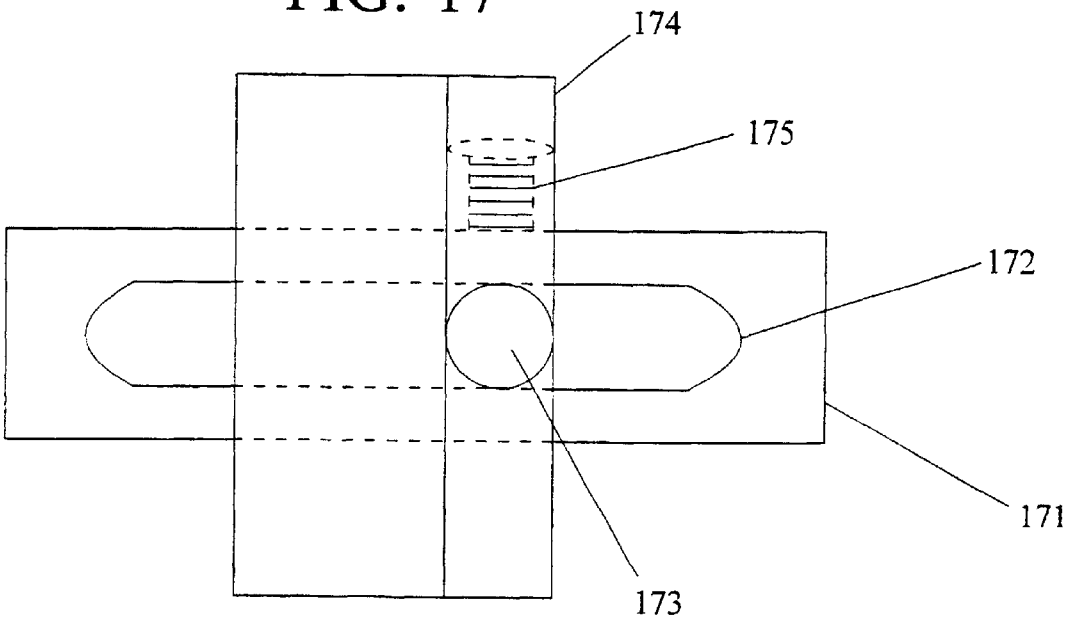
FIGS. 17 and 18 are an enlarged side view and top view, respectively, of a lower support bracket 170.
Figure 18:
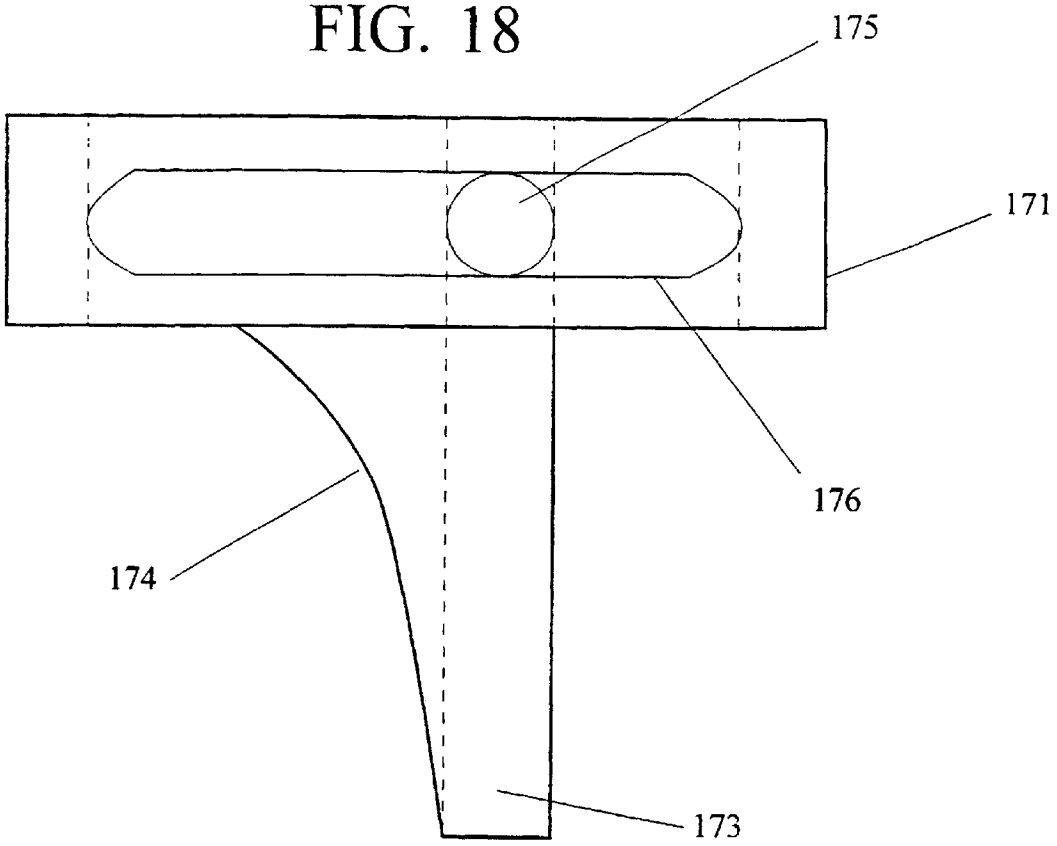

FIGS. 17 and 18 are a side view and a top view, respectively, of a lower support bracket 170. Lower support bracket 170 comprises a horizontal support member 171 which is bolted or otherwise affixed to the interior side walls of hard case 140. Horizontal support member 171 is equipped with a horizontal slot 172 in its front wall, and carries a horizontally extending post 173. Post 173 in turn carries a vertically disposed support cuff 174 which is provided with a half concave face which snugly seats against the lower portion of the rear body of a saxophone. Horizontally extending post 173 is slidably mounted within slot 172, and its position within slot 172 may be locked at any desired location using a simple set screw 175. Set screw 175 in turn rides in a second slot 176 provided on the top wall of horizontal support member 171, and may be tightened against horizontal support member 171, thereby locking the horizontal position of support cuff 174. Thus, the position of the support cuff may be placed at any desired position within the extent of slot 172, again in order to receive saxophones of varying dimensions.

Figure 19:
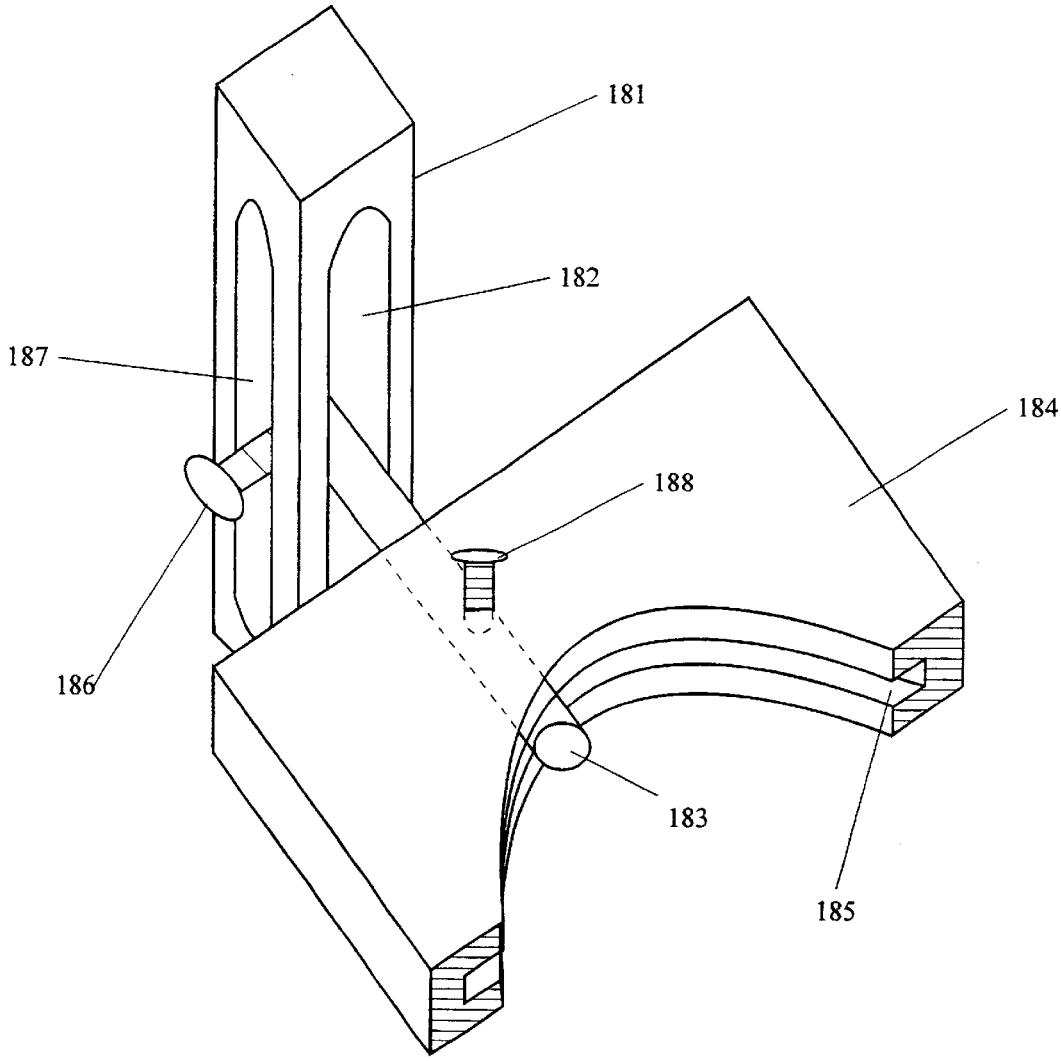
FIG. 19 is a side perspective view of a hard case bell clamp 184.

Likewise, FIG. 19 is a side perspective view of a bell clamp 180. Bell clamp 180 comprises a vertical support member 181 which is bolted or otherwise affixed to the interior side walls of hard case 140. Vertical support member 181 is equipped with a vertical slot 182 in its front wall, and carries a horizontally extending post 183. Post 183 in turn pivotally carries a generally C-shaped collar 184 which is adapted to partially encircle and thereby secure the bell of a saxophone 16. In order to secure the bell, the C-shaped collar 184 has an internal channel 185 running around its periphery. When a saxophone 16 is properly positioned inside hard case 140, the bell of the saxophone seats into channel 185. The angular orientation of collar 184 may be freely modified given its rotatable mount on post 183. The overall vertical position of collar 184 may be locked in place when desired using a simple set screw 186. Set screw 186 rides in a second slot 187 provided on the side wall of vertical support member 181, and may be tightened against vertical support member 181, thereby locking its vertical position and providing for the support of saxophones of varying dimensions. Likewise, a set screw 188 is provided on the upper face of collar 184, and may be tightened against post 183, thereby locking the angular position of collar 184 with respect to vertical support member 181.

In use, the hard case embodiment positions the saxophone in nearly the identical way as the soft case. After hard case 140 is opened, the bell of the saxophone is placed in one side of the case, directing the bell of the saxophone into channel 185 of bell collar 184, resting the bottom of the saxophone on the widened section of sound dampening material 190, and aligning the rear body portion of saxophone with the upper and lower support brackets 160 and 170, respectively. Once the saxophone has been properly positioned, each of the brackets and the bell collar are locked in place using their respective set screws.

Next, the saxophone is placed in the opposite side of hard case 140, and the same procedure is followed to align each of the bell collar, upper support bracket, and lower support bracket. When the alignment is completed, the hard case 140 is closed, bringing each of the support brackets into position against the appropriate section of the saxophone, in turn allowing a user to easily manipulate the saxophone and case assembly for muted practice while simultaneously offering a protective shell for transporting the saxophone.

Of course, both embodiments of the saxophone mufflers described above may be adapted to accommodate the different types of saxophones, namely, the alto, baritone, soprano and tenor saxophones, and only dimensions need be changed.

Moreover, the muffler can be readily adapted for use with other wind instruments, such as clarinets, to achieve the same advantageous results.

Having fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth therein.

Industrial Applicability

For the industrial application of saxophone mufflers and mutes, it is desirable to provide a muffler or mute for a saxophone which is able to reduce sound emanating both from the keys and the bell of the saxophone, without impinging on the tonality of the sound produced. Herein disclosed is a saxophone muffler or mute comprising a bag having interior layers of sound reducing material, and an exterior layer comprised of either a vinyl polymer fabric or a light and rigid plastic. The muffler covers the entirety of the saxophone except for the mouthpiece, and is provided on each side with a pocket for allowing access to the keys of the saxophone. By fully enclosing the saxophone inside the muffler of the present invention, the sound emanating from the bell and the keys of the saxophone are equally muted to provide a muted output that does not impinge on the pitch but only reduces the volume of the output.

What is claimed is:

1. A combination saxophone carrying case and saxophone muffler for muting the sound emanating from the keys and bell of a saxophone while maintaining the tonal quality thereof comprising:

an outer envelope configured to receive a saxophone body entirely therein, said outer envelope having a right side wall and a left side wall, said right side wall and said left side wall coming into contact with one another along their peripheries;

each of said right side wall and said left side wall having an interior surface comprised of sound dampening material;

said outer envelope having a mouthpiece receiving orifice positioned at an uppermost juncture of said right side wall and said left side wall through which the mouthpiece of said saxophone extends;

said right side wall having a right hand opening therein for providing access to right hand oriented keys of said saxophone;

said left side wall having a left hand opening therein for providing access to left hand oriented keys of said saxophone; and a support mechanism on an interior of said outer envelope for supporting said saxophone within said outer envelope.

2. The combination saxophone carrying case and saxophone muffler of claim 1, wherein said outer envelope comprises a fabric exterior layer overlying an interior layer of sound dampening material.

3. The combination saxophone carrying case and saxophone muffler of claim 2, said mouthpiece receiving orifice further comprising an annular rigid collar fully surrounding said orifice, said annular rigid collar having an off-center annular opening therein, said annular rigid collar being fixedly attached to the right side wall and the left side wall at said uppermost juncture, and said annular rigid collar having manual adjustment means thereon for adjusting a diameter of said collar.

4. The combination saxophone carrying case and saxophone muffler of claim 3, said annular rigid collar further comprising an elastomeric disk attached to a side wall of said collar, said side wall defining said off-center annular opening in said rigid collar, and said elastomeric disk having a hole therein for receiving the neck of said saxophone.

5. The combination saxophone carrying case and saxophone muffler of claim 2, said support mechanism further comprising:

a mounting stand;

a horizontally extendable rear support bracket extending from a rear end of said mounting stand for supporting the bottom back portion of a saxophone;

and an angularly and vertically adjustable saxophone bell brace extending upwardly from a front end of said mounting stand for supporting the periphery of a bell of said saxophone.

6. The combination saxophone carrying case and saxophone muffler of claim 5, said mounting stand further comprising:

an upper, vertical channel for receiving said saxophone bell brace;

a lower, horizontal channel for receiving said rear support bracket; and a central inclined face adapted to receive the bottom portion of said saxophone, said central inclined face having therein a central curved channel contoured to the bottom portion of a saxophone.

7. The combination saxophone carrying case and saxophone muffler of claim 6, said rear support bracket further comprising:

a horizontal extension member slidably inserted into said lower horizontal channel of said mounting bracket;

said horizontal extension member having a locking member for locking said horizontal extension member at a desired position with respect to said mounting bracket; and a vertical extension member having a notch at an upper end thereof, said notch receiving a horizontally adjustable post, and said post having at a forward end a support cuff for engaging the lower rear surface of said saxophone.

8. The combination saxophone carrying case and saxophone muffler of claim 6, said saxophone bell brace further comprising:

an arcuate collar having a centrally extending arm and a hinge member at a rear portion of said collar, said arcuate collar having an internal peripheral channel configured to receive a portion of the periphery of said saxophone bell;

said centrally extending arm having a slidably mounted clip positioned at one end for engaging the front of said saxophone bell at its periphery;

a locking member for locking the position of said slidably mounted clip with respect to said centrally extending arm;

a vertical bell clamp extension member slidably inserted into said upper vertical channel of said mounting bracket;

said vertical bell clamp extension member having a hinge member thereon pivotally receiving the hinge member of said arcuate collar; and a locking member on said vertical bell clamp extension member for locking the position of said vertical bell clamp extension member with respect to said mounting bracket.

9. The combination saxophone carrying case and saxophone muffler of claim 1, wherein said outer envelope comprises a rigid outer shell overlying an interior layer of sound dampening material.

10. The combination saxophone carrying case and saxophone muffler of claim 9, said mouthpiece receiving orifice further comprising an annular rigid collar fully surrounding said orifice, said annular rigid collar having an off-center annular opening therein, said annular rigid collar being fixedly attached to the right side wall and the left side wall at said uppermost juncture, and said annular rigid collar having manual adjustment means thereon for adjusting a diameter of said collar.

11. The combination saxophone carrying case and saxophone muffler of claim 10, said annular rigid collar further comprising an elastomeric disk attached to a side wall defining said off-center annular opening in said rigid collar said elastomeric disk having a hole therein for receiving the neck of said saxophone.

12. The combination saxophone carrying case and saxophone muffler of claim 9, said support mechanism further comprising:

a section of increased thickness of sound dampening material on the interior of each of said left side wall and said right side wall, said section of increased thickness of sound dampening material being contoured to closely support the bottom and front portions of said saxophone;

an upper support bracket attached to the interior of each of said left side wall and said right side wall for supporting the upper body of said saxophone;

a lower support bracket attached to the interior of each of said left side wall and said right side wall below said upper support bracket for supporting the lower body of said saxophone; and and an angularly and vertically adjustable saxophone bell brace attached to the interior of each of said left side wall and said right side wall for supporting the periphery of the bell of said saxophone.

13. The combination saxophone carrying case and saxophone muffler of claim 12, said upper support bracket further comprising:

a vertical support bracket fixedly attached to the interior of each of said left side wall and said right side wall, said vertical support having therein a vertical notch;

a horizontally extending post slidably mounted in said vertical notch;

a locking member for locking the position of the horizontally extending post with respect to said vertical notch; and a horizontally oriented support cuff mounted on an outer end of said horizontally extending post for engaging the side wall of the upper portion of a saxophone body.

14. The combination saxophone carrying case and saxophone muffler of claim 12, said lower support bracket further comprising:

a horizontal support bracket fixedly attached to the interior of each of said left side wall and said right side wall, said horizontal support having therein a horizontal notch;

a horizontally extending post slidably mounted in said horizontal notch;

a locking member for locking the position of the horizontally extending post with respect to said horizontal notch; and a vertically oriented support cuff mounted on an outer end of said horizontally extending post for engaging half of the rear wall of the lower portion of a saxophone body.

15. The combination saxophone carrying case and saxophone muffler of claim 12, said saxophone bell brace further comprising:

a vertical support bracket fixedly attached to the interior of each of said left side wall and said right side wall, said vertical support having therein a vertical notch;

a horizontally extending post slidably mounted in said vertical notch;

a locking member for locking the position of the horizontally extending post with respect to said vertical notch;

an arcuate collar rotatably mounted on said horizontally extending post; and a locking member for locking the angular orientation of said arcuate collar with respect to said vertical notch;

said arcuate collar having an internal peripheral channel configured to receive a portion of the periphery of said saxophone bell for holding the saxophone bell in place during use.

* * * * *

UNITED STATES PATENT AND TRADEMARK OFFICE

CERTIFICATE OF CORRECTION

PATENT NO. : 6,239,338 B1
DATED : May 29, 2001
INVENTOR(S) : David George Robinson It is certified that error appears in the above-identified patent and that said Letters Patent is hereby corrected as shown below:

Title page,
Item [76], inventor's address should read -- 2601 -- instead of "2610"

Signed and Sealed this

Fourteenth Day of May, 2002

*Attest:*

*Attesting Officer*

JAMES E. ROGAN
*Director of the United States Patent and Trademark Office*